United States Patent [19]

Armstrong

[11] 4,362,028

[45] Dec. 7, 1982

[54] MULTI-BOWL BEVERAGE DISPENSERS

[75] Inventor: Alfred Armstrong, Norwood, Mass.

[73] Assignee: Crathco, Inc., Canton, Mass.

[21] Appl. No.: 224,941

[22] Filed: Jan. 14, 1981

[51] Int. Cl.[3] ..... B67D 5/62

[52] U.S. Cl. ..... 62/390; 62/399; 62/521; 222/146 C

[58] Field of Search ..... 62/383, 389, 390, 392, 62/393, 399, 520, 521, 522; 222/146 C

[56] References Cited

U.S. PATENT DOCUMENTS

| | | | |
|---|---|---|---|
| 2,039,556 | 5/1936 | Ruse | 62/399 |
| 2,486,957 | 11/1949 | McGrew | 62/393 |
| 3,060,702 | 10/1962 | Price, Jr. | 62/392 |
| 3,269,606 | 8/1966 | Armstrong | 62/392 |

*Primary Examiner*—Ronald C. Capossela
*Attorney, Agent, or Firm*—James E. Mrose

[57] ABSTRACT

In a refrigerated beverage dispenser having a plurality of coplanar circular cooling plates closing the bottoms of an array of beverage bowls, each concentric turn of a single multi-turn sinuous coiling of evaporator tubing is bonded in intimate heat-exchange relationships with all of the cooling plates and directs flow of the refrigerant serially across and part way around each cooling plate, and back, in succession. Tubing which interconnects across the spaces between adjacent cooling plates is clustered, to promote maximum arcuate spanning of the plates by those more active portions of the tubing best disposed to provide the cooling.

7 Claims, 5 Drawing Figures

MULTI-BOWL BEVERAGE DISPENSERS

BACKGROUND OF THE INVENTION

The present invention relates to improvements in refrigerated beverage dispensers of the type involving a plurality of cooling plates, and, in one particular aspect, to novel and improved multi-bowl beverage dispensers wherein uniform and efficient chilling by way of separate flat cooling plates may be effected at low manufacturing cost through use of multi-turn sinuous coiling of evaporator tubing in which each turn extends serially across and part way around each plate, and back, in succession.

Apparatus for the counter-top display, cooling and dispensing of beverages has been known for some time in single-stand versions which mount more than one bowl or tank, and which thereby afford a convenient and compact means for exhibiting and serving different colorful soft drinks. Such apparatus has economically employed what is basically a single refrigeration system, including one motor-operated compressor and condenser, together with one evaporator split into different sections associated with cooling surfaces serving the different bowls. It has been observed that heat-exchange balance, as between two such bowls, should be benefitted by first arranging some evaporator coils, which are upstream in relation to the refrigerant supply, close to one bowl, and then locating intermediate coils close to another bowl, and then bringing the remaining downstream coils close to the first bowl. U.S. Pat. No. 3,060,702 describes and shows that kind of coil-splitting in relation to a twin-tank dispenser and in relation to two tiers of spiralled coil turns at each site. Similarly, U.S. Pat. No. 3,341,077 discusses and illustrates essentially the same thing, for like reasons, albeit in the context of tubing wound inside domes which project upwardly into two bowl compartments sharing a common wall. My U.S. Pat. No. 3,269,606 discloses a flat cooling plate to the underside of which is bonded a substantially flat spiral of evaporator tubing, and multiple-bowl dispensers of the present invention may usefully involve a plurality of such plates, although with the evaporator tubing arranged quite differently. Stacking of evaporator-coil sections, such as is resorted to in both of said U.S. Pat. Nos. 3,060,702 and 3,341,077, tends to complicate the winding, assembly, interconnecting and solder-bonding of the spiral or helical evaporator, and it adds height and bulk which is not readily accommodated unless one is willing to tolerate upwardly-projecting domes. Where there is stacking of spiral coils below flat cooling plates, there is also necessarily a less intimate heat-exchange relationship between some of such coils and the plates. Subdividing of the evaporator coiling into enough sections to make possible finer balance of cooling as between several bowls would at the same time entail manufacturing complexities and costs which would be highly unwelcome.

SUMMARY OF THE INVENTION

In one preferred expression of the present invention, the three side-by-side cooling plates of a triple-bowl beverage dispenser are each separately engaged and bonded with a single layer of substantially concentric partial turns of evaporator coiling formed from a single length of tubing. However, each such partial turn for each plate is in a series relation with its positional counterpart serving the other two plates, rather than being serially grouped directly with other turns serving the same plate, and, for that reason, the refrigerant must course downstream by traversing a partial turn for a first plate, then one for an intermediate plate, then one for the third, then one for the intermediate plate once again, and then back to the first, and so on until the downstream end of the tubing has been reached and desired cooling has been effected. A simple tubular winding which promotes that preferred sequential coursing of refrigerant, and an attendant uniformity in cooling, is fashioned as an elongated spiral flat looping in which the ends and a middle section are substantially circular, with intervening "waist" portions being bunched toward the axis of elongation.

Accordingly, it is one of the objects of the present invention to provide unique and effective uniform heat-exchange between cooling plates and a single evaporating-coil unit in a multi-bowl beverage dispenser.

Another object is to provide new and improved combinations of plural flat cooling plates and a single elongated-spiral evaporator-coil loop, which lend themselves to low-cost manufacture and which together promote uniform cooling in a multi-bowl beverage dispenser.

BRIEF DESCRIPTION OF THE DRAWINGS

Although those aspects of this invention which are considered to be novel are expressed in the appended claims, further details as to preferred practices and as to further objects and features thereof may be most readily comprehended through reference to the following detailed description when taken in connection with the accompanying drawings, wherein:

DETAILED DESCRIPTION OF THE PREFERRED EMBODIMENTS

Figure 1:
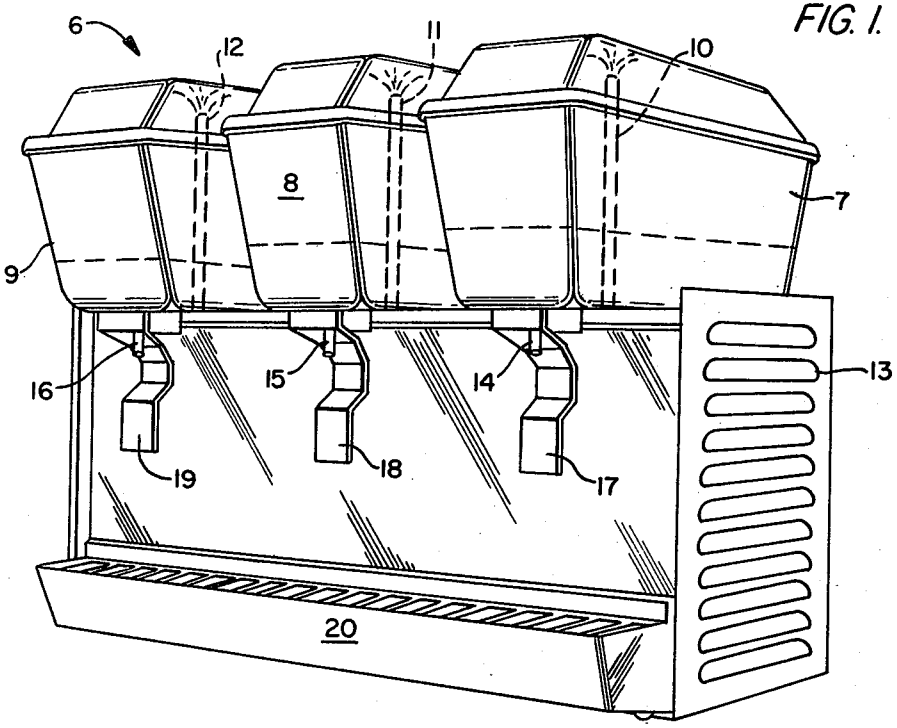
FIG. 1 is a pictorial representation of a triple-bowl beverage conditioner and dispenser in which the present teachings may be exploited to particular advantage.

Having reference to the drawings, wherein like reference characters designate identical or corresponding components and units throughout the several views, and more particularly to FIG. 1 thereof, a liquid cooler and dispenser 6 is there shown in a relatively small and lightweight form intended for attractive counter-top display of three different beverages, such as chilled juices or syrup drinks. Aesthetic appeal which aids in the merchandizing of such beverages is promoted through use of transparent storage tanks, such as the trio of molded-plastic bowls 7, 8, and 9, which expose to customer view their continuously-circulated colorful liquid contents. Removable plastic covers atop those bowls allow access for refilling and cleaning and also serve to deflect upwardly-sprayed recirculated liquid forcefully discharged from the tops of upstanding spray tubes 10, 11 and 12 within the three bowls. Each of the bowls is fitted on top of the enclosed louvered stand 13, with their forward ends slightly overhanging the front of the stand to afford access to their tap valve outlets 14, 15 and 16 and their dispensing levers 17, 18 and 19. Removable tray 20 conveniently collects any beverage overflow.

Figure 2:
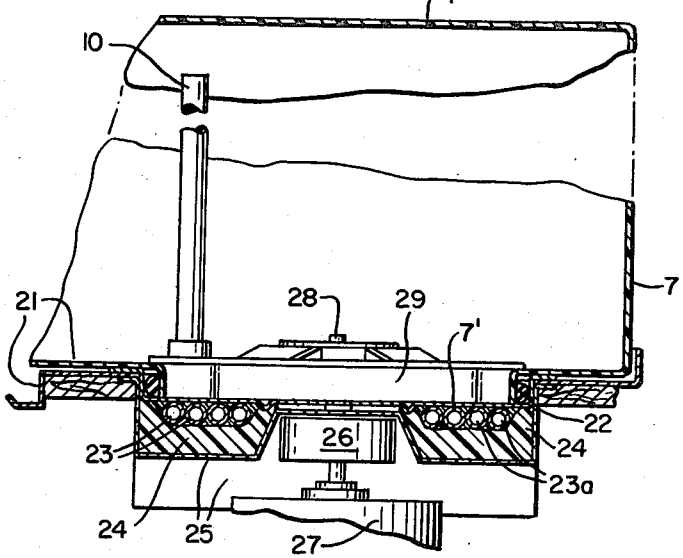
FIG. 2 is a partly cross-sectioned side view of an evaporator-coil association with one of the cooling plates of a dispenser such as that of FIG. 1, together with fragments of a bowl and stand and pumping mechanisms.

As viewed in FIG. 2, the arrangement whereby chilling of beverage is effected, in the case of bowl 7 but similarly for the other two as well, is that wherein a circular metal cooling plate 7' is at the bottom of a shallow well recessed downwardly from the metal-sheathed top 21 of the stand 13. Refrigeration of beverage contained in the bowl 7, a neck of which has been fitted into and sealed with the top well by a gasket 22, is effected by way of evaporator-tube coiling 23 through the cooling plate 7'. As appears more fully later herein, the evaporator coiling 23 is made up of one length of thermally-conductive tubing which has been fashioned into one elongated multi-turn flat loop having three sections, each section serving a different one of the three cooling plates but the one stream of refrigerant through the one coiling acting to withdraw heat through all plates in concert, and substantially uniformly because of the fine sequencing involved. Coiling 23 is part of a generally conventional type of refrigerating system enclosed with the stand 13, and it is insulated from heat-exchange losses in relation to other components within the stand by an insulating plastic 24, preferably in the form of an expanded polyurethane foam. For the latter purposes, a molded plastic shell 25 is fitted around and below the coiling, with ample space to accommmodate a fill of foam sufficient to keep losses to an acceptable low level. The evaporator coiling is confined to annular regions, as appears more fully in FIGS. 3 and 5. such that the central part of the cooling plate may be in close proximity with a magnetized clutch member 26 which is rotated from beneath by an electric motor 27. That clutch member interacts with a vaned impeller (not shown) located above the cooling plate and rotates it at high speed about a central stud, 28, within a spirally-channelled pump member 29. Beverage within the bowl is thereby pumped outwardly and upwardly through the standpipe 10, whence it splashes against the cover and sides of bowl 7. Those pumping features are described in detail in my aforesaid U.S. Pat. No. 3,269,606, and it will of course be understood that beverage in each of the three bowls 7, 8 and 9 is similarly pumped and sprayed.

Figure 4:
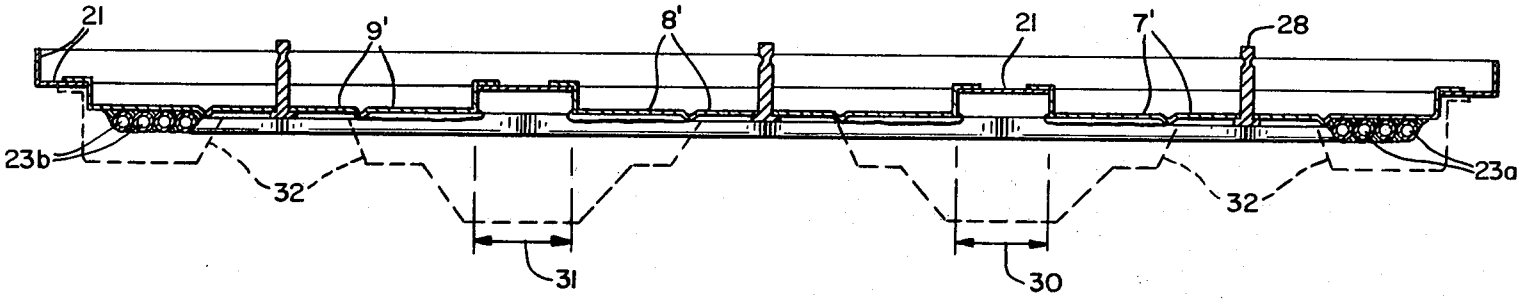
FIG. 4 is a longitudinal cross-section of the sub-assembly represented in FIG. 3.
Figure 3:
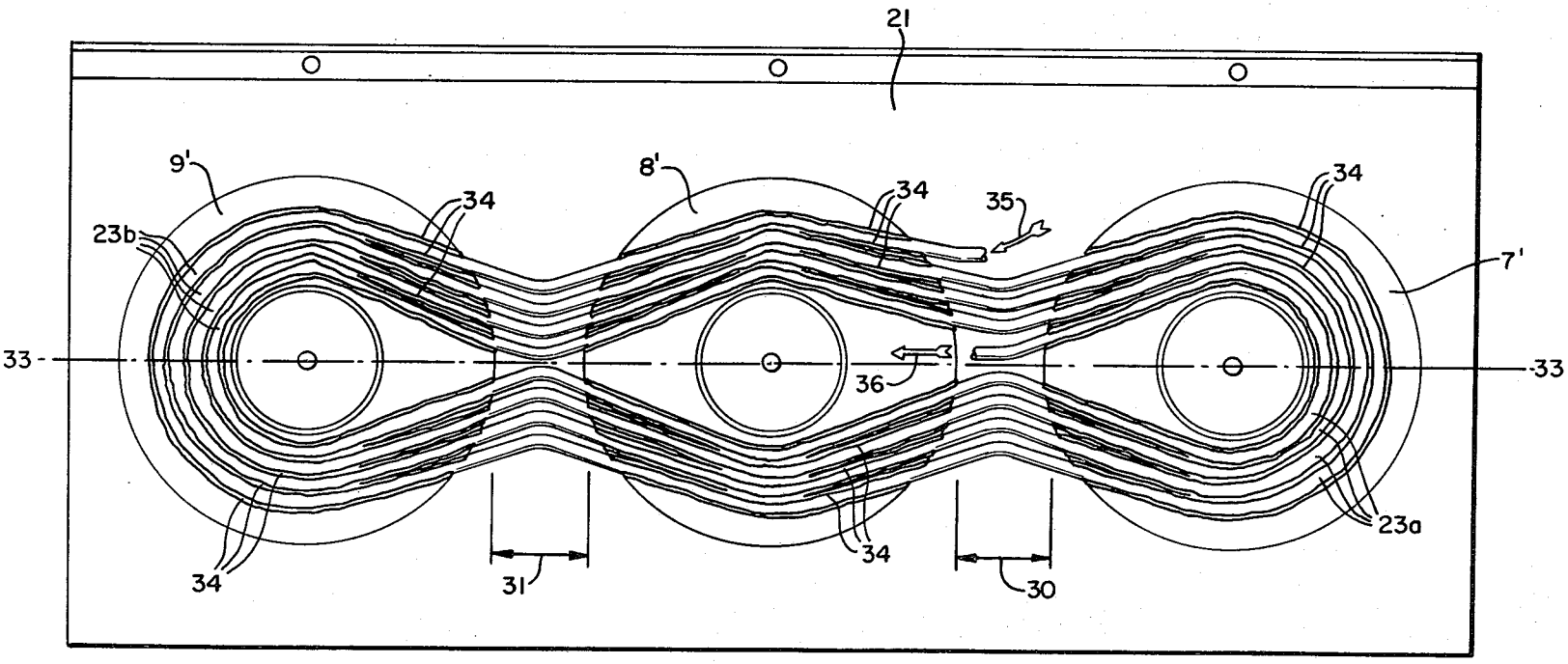
FIG. 3 illustrates the dispenser sub-assembly involving three cooling plates and single shaped-loop evaporator coiling, from below in relation to a structure such as that in FIG. 1.

FIG. 3 views from below the sub-assembly of the evaporator coiling 23 with the three cooling plates, 7', 8' and 9', and with the stand top 21. The three cooling plates are set in a longitudinal side-by-side array, with unavoidable lateral spacings 30 and 31 occasioned by need to accommodate the lateral expanses of the bowls used above them. Those spacings are spanned by the tubing which makes up the single evaporator coiling, and, because no beverage cooling can be effected efficiently at those sites, they are kept well insulated, as by the aforementioned foam plastic 24, which is purposely introduced at those sites within the shell 25. In the latter connection, a suitable lateral spanning and insulation-containing configuration for shell 25 is represented by dashed linework 32 in FIG. 4. Close inspection of the elongated evaporator coiling 23 (FIGS. 3 and 5) reveals that the single length of heat-conducting tubing of which it is comprised is wound generally as an elongated loop, with successive turns being laid adjacent one another in substantially the same place. With the object of extracting the maximum amount of heat from each of the three cooling plates, but at the same time doing so substantially uniformly in respect of all three circular plates, the four adjacent turns overlying the plates are caused to extend arcuately around as much of a circle as is possible under the circumstances. In the cases of cooling plates 7' and 9', which are disposed above opposite ends of the elongated loop of coiling 23, the associated loop end turns, **23*a* and 23*b*, respectively, extend most of the way around the annular regions where cooling can be effected. That leaves the ends of those turns, 23*a'* and 23*b*, which turns are each discontinuous and substantially concentric with the others, rather than being spiralled, in a clustered relationship as near the longitudinal axis 33—33 of the loop as is practical. In that manner, not only are the end turns 23*a* and 23*b* each caused to be of maximum arcuate lengths but the intermediate concentric arcuate lengths of the tubing, 23*c*, serving the middle cooling plate 8'**, are also arcuately wrapped around as much of that plate's annular cooling region as is practical.

Figure 5:
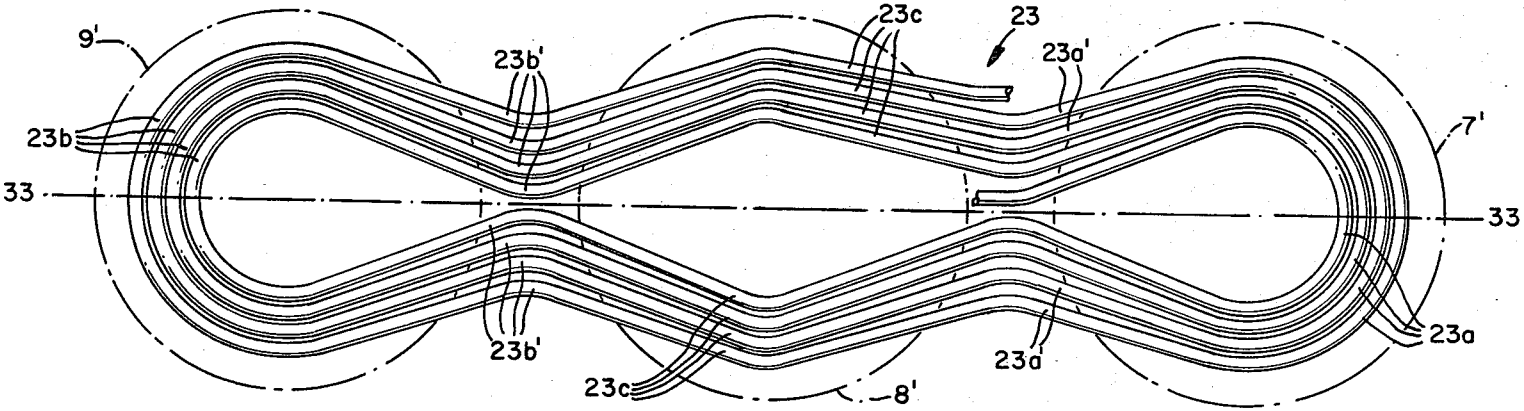
FIG. 5 portrays the shaped-loop evaporator coiling in FIG. 3, independently of its relation to that sub-assembly, but with dashed linework representing the locus of each of three cooling plates with which it is intended to cooperate.

Relatively soft copper tubing is conveniently used to fabricate the evaporator coiling, and may be laid upon a flat work surface and manually wrapped about a suitable array of upstanding projections therefrom to form the appropriately-shaped unit appearing in FIG. 5. Thereafter, the unit is abutted with lower surfaces of the metal cooling plates mounted in the stand top, and molten solder is flowed between adjacent turns and around peripheral edges of the turns wherever they overlie the plates. The resulting solder bonding, 34, unfies the plates and tubing into efficient heat-transfer relationships. Flow of refrigerant from the upstream end of the coiling, where its cooling effects are at a maximum, as designated by arrow 35 (FIG. 3), is first arcuately about one part of the middle cooling plate tubing **23*c*, thence through nearly a full outer turn of tubing 23*a* underlying end plate 7', next back across middle cooling plate 8' through an opposite part of tubing 23*c*, and then through nearly a full outer turn of tubing 23*b* underlying end plate 9'. At that juncture, the refrigerant at its maximum cooling efficacy has traversed one full loop of the evaporator coiling and has been brought into good heat-exhange relationship with all three cooling plates. Three further such circuits are next completed in sequence, through the remaining turns, with the downstream output of least-potency refrigerant being near the input site, as represented by arrow 36**. Net effects, reflecting factors including the efficacy of refrigerant at successive positions along the coiling, and the extents to which tubing at the successive positions are in engagement with the cooling plates, are such that uniform chilling is promoted among the three plates. That uniformity is important not only from the obvious standpoint of having all three beverages well cooled but from the perhaps less evident standpoint of efficiency and economy of the one refrigerating system used for the multi-bowl combination. In the latter connection, it is noted that if any cooling plate were to be left consistently warmer than the others, and its warmer temperature causes the refrigerating system to operate more than necessary, then the other units become cooler than necessary and energy is wasted by the system. Control of the opposite sense, governed by undue cooling of one unit, would of course leave beverages in the other units less chilled than should be the case. The "incremental" cooling sequencing achieved in accordance with practice of this invention helps to avoid such problems and to conserve energy; in addition, the flat single-loop coiling vastly simplifies and promotes economical manufacture of a multi-bowl dispenser.

It should be understood that the specific embodiments and practices described in connection with this specification have been presented by way of disclosure rather than limitation, and that various modifications, combinations and substitutions may be effected by those skilled in the art without departure either in spirit or scope from this invention in its broader aspects and as set forth in the appended claims.

What I claim as new and desire to secure by Letters Patent of the United States is:

1. A beverage dispenser, comprising a stand housing a refrigeration system, a plurality of cooling members mounted on said stand with first surfaces oriented to transfer heat away from beverage in bowls on said stand, said cooling members all having second surfaces opposite said first surfaces in heat-transferring engagements with one evaporator in said refrigeration system, said evaporator having a single refrigerant passageway therethrough in the general form of a single multi-turn elongated loop with coplanar concentric turns, the sucessive passageway turns in said loop each coursing substantially arcuately about at least part of each of said cooling members, in succession, and then similarly coursing back across said cooling members in the opposite sequence to complete each turn in said loop, whereby to promote uniformity in cooling by said members.

2. A beverage dispenser as set forth in claim 1 wherein said cooling members are in the form of substantially flat circular plates the said second surfaces of which are substantially coplanar, and wherein said evaporator comprises a substantially flat elongated loop made up of multiple turns of tubing abutted concentrically with said second surfaces of all of said cooling plates.

3. A beverage dispenser as set forth in claim 2 wherein said cooling plates are laterally spaced to accommodate side-by-side placement of the beverage bowls with which they cooperate, wherein substantially the same number of turns of said tubing is involved in the heat-transferring abutments with all of said cooling plates, wherein said turns abut each of said cooling plates within a substantially annular region concentric therewith, and wherein the portions of said turns which span spacing between said cooling plates are clustered together in narrowed waist-like sections to promote large-angle arcuate abutments of said tubing with said plates.

4. A multi-bowl beverage dispenser, comprising a stand housing a refrigeration system, a plurality of spaced-apart substantially circular cooling plates exposed atop said stand in position to transfer heat away from beverage in bowl compartments disposed above said stand, all of said plates having lower surfaces which are substantially coplanar with one another and which are united in heat-transferring engagements with one evaporator in said refrigeration system, said evaporator having a refrigerant passageway therethrough in the general form of a single multi-turn flat loop which is elongated in direction of lateral spreading of said spaced-apart plates, the successive passageway turns in said loop each being substantially concentric and coursing substantially arcuately about at least part of each of said cooling plates, in succession, and then similarly coursing back across said cooling members in the opposite sequence to complete each turn in said loop, whereby to promote uniformity in the chilling of beverages in all the bowl compartments by said cooling plates.

5. A multi-bowl beverage dispenser as set forth in claim 4 wherein said turns of said loop are in heat-transfer engagements with each of said cooling plates within a substantially annular region concentric therewith, and wherein the portions of said turns which span spacing between said spaced-apart plates are clustered together in narrowed waist-like sections to promote large-angle arcuate engagements between said plates and the portions of said turns which underly said plates in the annular regions thereof, and wherein substantially the same number of turns is involved in the heat-transfer engagements with all of said cooling plates in said annular regions.

6. A multi-bowl beverage dispenser as set forth in claim 4 wherein said cooling plates are three in number and are in a sunstantially linear spaced-apart array with their centers lying along a common linear path, wherein the flat loop formed by said evaporator passageway is elongated in direction of said path and includes substantially full turns about the outside plates and pairs of substantially half turns about the intermediate plates.

7. a multi-bowl beverage dispenser as set forth in claim 6 wherein said evaporator is formed by a single tube having said portions of said turns underlying said plates soldered with said plates, and wherein said loop commences heat-transfer engagements with substantially a half turn about said intermediate plate and ends said heat-transfer engagements with a substantially full turn about the end plate next to the position where said loop commences.

* * * * *